US008573622B2

(12) United States Patent
Papi et al.

(10) Patent No.: US 8,573,622 B2
(45) Date of Patent: Nov. 5, 2013

(54) WHEELCHAIR

(75) Inventors: Luciano Papi, Cobbitty (AU); Steven Mark Smith, Wollongong (AU)

(73) Assignee: Lu Papi & Associates Pty Ltd, Cobbitty, NSW (AU)

( * ) Notice: Subject to any disclaimer, the term of this patent is extended or adjusted under 35 U.S.C. 154(b) by 566 days.

(21) Appl. No.: 12/295,913

(22) PCT Filed: Apr. 4, 2007

(86) PCT No.: PCT/AU2007/000451

§ 371 (c)(1),
(2), (4) Date: Jun. 1, 2009

(87) PCT Pub. No.: WO2007/112508

PCT Pub. Date: Oct. 11, 2007

(65) Prior Publication Data

US 2010/0007114 A1 Jan. 14, 2010

(30) Foreign Application Priority Data

Apr. 4, 2006 (AU) ..... 2006901768

(51) Int. Cl.
*A61G 5/00* (2006.01)
*B62M 1/14* (2006.01)

(52) U.S. Cl.
USPC ..... 280/250.1; 280/304.1

(58) Field of Classification Search
USPC ..... 280/250.1, 304.1
See application file for complete search history.

(56) References Cited

U.S. PATENT DOCUMENTS

| | | | | |
|---|---|---|---|---|
| 2,895,742 | A | 7/1959 | Johnson | |
| 4,190,263 | A * | 2/1980 | Powers | 280/250.1 |
| 4,405,142 | A | 9/1983 | Whetstine | |
| 4,572,533 | A * | 2/1986 | Ellis et al. | 280/250.1 |
| 4,721,321 | A | 1/1988 | Haury et al. | |
| 5,409,247 | A | 4/1995 | Robertson et al. | |

(Continued)

FOREIGN PATENT DOCUMENTS

| | | | |
|---|---|---|---|
| DE | 20 2004 007 928 | U1 | 7/2004 |
| EP | 1 260 383 | A2 | 11/2002 |

(Continued)

OTHER PUBLICATIONS

International Search Report for PCT International Application No. PCT/AU2007/000451, mailed Jul. 4, 2007.

(Continued)

*Primary Examiner* — Kevin Hurley
*Assistant Examiner* — Marc A Scharich
(74) *Attorney, Agent, or Firm* — RatnerPrestia

(57) ABSTRACT

A wheelchair comprises a frame and first and second rear wheels that are each independently mounted to the frame via a respective mounting hub. Each rear wheel is detachably mounted to its respective mounting hub at two or more distinct hub mounting points. Either or both of the hub mounting points can be movable with respect to a remainder of the hub, for example via a pivoting arrangement. A disk can be positioned at the rear wheel and a stop element located at the mounting hub can be selectively operated to interfere with the disk to prevent rotation of that rear wheel. The frame can comprise first and second spaced apart and unitary tubes which each extending in an unbroken manner from a wheelchair seat to a wheelchair forward region.

17 Claims, 15 Drawing Sheets

(56) References Cited

U.S. PATENT DOCUMENTS

| | | | | |
|---|---|---|---|---|
| 5,590,893 | A * | 1/1997 | Robinson et al. | 280/250.1 |
| 5,984,334 | A * | 11/1999 | Dugas | 280/250.1 |
| 6,168,178 | B1 * | 1/2001 | Garven et al. | 280/250.1 |
| 6,478,099 | B1 | 11/2002 | Madwed | |
| 6,623,022 | B2 * | 9/2003 | Malassigne et al. | 280/250.1 |
| 2002/0149168 | A1 | 10/2002 | Brown | |
| 2005/0012303 | A1 * | 1/2005 | Hargroder | 280/304.1 |
| 2005/0116440 | A1 * | 6/2005 | Bernatsky et al. | 280/250.1 |
| 2006/0087098 | A1 * | 4/2006 | Peterson et al. | 280/304.1 |
| 2006/0237943 | A1 * | 10/2006 | Lai | 280/250.1 |
| 2008/0265542 | A1 * | 10/2008 | Chong | 280/250.1 |

FOREIGN PATENT DOCUMENTS

| | | |
|---|---|---|
| FR | 2 800 603 | 5/2011 |
| GB | 2 347 655 | 9/2000 |
| GB | 2 393 153 A | 3/2004 |
| JP | 8-150178 | 6/1996 |
| JP | 11-169412 | 6/1999 |
| WO | WO 00/69385 | 11/2000 |

OTHER PUBLICATIONS

European Search Report for EP 07 718 698.9, Apr. 16, 2010.
EPC Communication for EP 07 718 698.9, Mar. 7, 2013.

* cited by examiner 55
56
52A
34
16B
32
53
62
54
16A
68
74
70
64
78
76
62

WHEELCHAIR

This application is a U.S. National Phase Application of PCT International Application No. PCT/AU2007/000451, filed Apr. 4, 2007.

TECHNICAL FIELD

A wheelchair is disclosed that can have normal, commode and shower usage modes.

BACKGROUND ART

Wheelchairs comprise a rear axle for the rear wheels which can limit the applications in which the chairs are employed, and also force certain constructional restrictions on the wheelchair.

U.S. Pat. No. 5,590,893 discloses a wheelchair frame assembly comprising a number of frame components which, whilst eliminating the wheelchair rear axle, is relatively complex to form and can result in a heavier frame weight.

A reference herein to a prior art document is not an admission that the document forms a part of the common general knowledge of a person of ordinary skill in the art in Australia or elsewhere.

SUMMARY OF THE DISCLOSURE

In a first aspect there is disclosed a wheelchair comprising a frame and first and second rear wheels that are each independently mounted to the frame via a respective mounting hub at a hub mounting point that is movable with respect to a remainder of the hub.

For example, the remainder of the mounting hub may comprise a portion that can be fixedly mounted to the frame, with the mounting point being located in a mounting hub portion that is pivotable with respect to the fixed portion.

This capability of the mounting point to move (eg. to pivot) can enable a suspension characteristic to be provided to each rear wheel. For example, a shock absorber can be positioned to act between the fixed and movable mounting hub portions, to enable each rear wheel to have its own shock absorption capability. For simplicity, the shock absorber can comprise eg. a polymeric block, although mechanical or hydraulic suspension can be employed if desired.

In one embodiment the pivotable mounting hub portion can be pivotally mounted to an in-use proximal region of the fixed mounting hub portion, with the shock absorber being located for operation at a location that is remote from the proximal region.

The wheelchair may further comprise a height adjustment mechanism located for operation between the fixed and movable mounting hub portions whereby small height adjustments up and down can be made. For example, the height adjustment mechanism can comprise a screw mechanism located for operation between the fixed and movable portions, whereby small frame height adjustments up and down can be made. This mechanism can enable the frame height at a given side of the wheelchair to be independently adjusted so that different user requirements can be accommodated.

In one embodiment each rear wheel is detachably mounted to its respective mounting hub at two or more distinct hub mounting points.

By providing distinct hub mounting points the configuration of the wheelchair can simply and readily be altered. For example, at least one such mounting point can be positioned in the mounting hub at a location that in use is lower than that of another of the mounting points. This enables the mounting location of each rear wheel to be changed and the in-use height of the wheelchair frame to be altered. This height change can help to adapt the wheelchair to different modes of use such as a normal chair usage mode, a commodal usage mode and a shower usage mode etc.

Also, by providing respective mounting hubs, the wheelchair rear wheel axle can be eliminated. This can facilitate wheelchair use in the commodal usage mode. In addition, rear wheel independence can be established, allowing for an independent adjustment, suspension, shock absorption, replacement, servicing etc of each rear wheel.

At least one of the mounting points may also be adjustable in the mounting hub forward and backwards with respect to the frame to enable a rear wheel centreline to be correspondingly altered with respect to the frame. This can change the performance of the wheelchair and also allow for different user weight distributions to be accommodated (eg. the rear wheel centreline can be repositioned depending on where a given user typically sits in the chair).

In one embodiment the inclination of mounting at a given mounting point can be changed such that rear wheel camber can be altered. For example, the inclination of the given mounting point can be changed by interchanging a bush of that mounting point with a bush that has an internal bore having a different inclination. This can allow for wheelchair camber adjustment for eg. different surfaces on which the wheelchair is employed.

In one embodiment each rear wheel has a mounting pin that protrudes from a central wheel hub thereof to be releasably received in the mounting point (eg. in the bush internal bore). For example, the mounting pin can be provided as a quick-release pin to enable rapid attachment/detachment of each rear wheel to/from a mounting point in the hub.

In a second aspect there is disclosed a disk positionable for operation between at least one wheelchair rear wheel and a mounting region at which the wheel can be mounted to a frame of the wheelchair, the disk being located such that a stop element located at the mounting region can be selectively operated to interfere with the disk to prevent rotation of that rear wheel.

The disk enables a given rear wheel to be locked against rotation, for example, in a fail-safe mode of operation, thereby providing additional safety benefits.

Usually the disk is fixedly mounted with respect to the wheel, and usually a disk is fixed to each rear wheel of the wheelchair. For example, the disk can be positioned for operation between each rear wheel and its respective mounting hub. The stop element can then be located at the mounting hub to be selectively operated to interfere with the disk to prevent rear wheel rotation.

The stop element can comprise a braking pin located at the mounting hub that is selectively extendable therefrom. In an extended position, the braking pin can interfere with the disk to prevent rear wheel rotation. For example, the braking pin can be spring-loaded into the extended position, for example, in a fail-safe mode of operation. However, the braking pin may then be displaced into and retained at a retracted position whereby it is withdrawn from interference with the disk.

In one mode, to interfere with the disk in the extended position, the braking pin can extend through one of a plurality of slots defined within the disk to positively prevent rear wheel rotation. When displaced to the retracted position the pin is then withdrawn from the slot. Each of the slots can be elongate curved or straight such that, in the extended position, the braking pin can still extend through one of the slots at one or more different relative positions of the mounting hub with respect to the frame.

In a third aspect there is disclosed a push-rim for manual engagement and drive of a wheelchair wheel, the push-rim comprising:

an elastomeric outer layer to facilitate manual gripping; and/or an externally facing generally flat side face.

Both the elastomeric outer layer and the externally facing generally flat side face can better facilitate manual gripping of the push-rim and thus operation of the wheelchair by a user thereof (eg. when moisture is present on a user's hands).

In one form the elastomeric outer layer can be moulded over a rigid inner material of the push-rim.

Also, the push-rim can be located externally on a wheelchair rear wheel in use.

In a fourth aspect there is disclosed a wheelchair main frame that comprises first and second spaced apart and unitary tubes which each extend in an unbroken manner from a wheelchair seat to a forward region of the wheelchair.

The use of unbroken tubes in the main frame can enable a wheelchair to be produced that is lightweight and of a simplified and compact construction, and that may also assume a compact collapsed form. In one sense, the wheelchair can be seen as being constructed around the first and second tubes of the main frame.

In use, each of the first and second tubes can have, at the forward region, a first generally downwardly sloped portion to which a respective front wheel can be mounted, with the first portion curving back to a second generally more gradually sloped portion to which a respective side of the seat together with a respective rear wheel can be mounted. In other words, each tube can be bent so as to define respective portions which provide for front and rear wheel mounting thereto, and also provide for seat mounting thereto.

Each tube can be formed of a special stainless steel alloy that provides a tube having a thin (and a strong but lightweight) wall, with good corrosion resistance (eg. a tube formed from Nanoflex material—a trade mark of Sandvik AB).

In addition, a wheelchair backrest can additionally be mounted at proximal ends of each of the first and second tubes, and a respective rear wheel mounting hub can be fastened to each of the first and second tubes adjacent to their proximal ends.

The first and second tubes can be interconnected by at least two spaced cross-bracing members, with a first cross-bracing member being located to extend between the tube proximal ends, and with a second cross-bracing member extending between the tubes at a location that is spaced from the first cross-bracing member. For example, three spaced cross-bracing members can be provided, with each being demountable and interchangeable to enable the spacing between the first and second tubes to be altered (eg. to accommodate different sized users such as users of different widths).

The three spaced cross-bracing members can be defined by:

the first cross-bracing member located at the tube proximal ends;

the second cross-bracing member which is located intermediate the tube proximal ends and a distal end of the tubes; and a third cross-bracing member located at the tube distal ends.

A footrest can also be mounted at the third cross-bracing member, the footrest being connected to the third member via clips at its underside which enable the footrest to tilt about the third member.

In a fifth aspect there is disclosed a wheelchair that comprises first and second backrest members which, in use, extend generally upwards from a proximal end of a frame for the wheelchair, with each backrest member being pivotally connected to the frame via a respective mounting hub to enable adjustment of the backrest members with respect to the frame.

The mounting hubs can support the backrest members independently of the frame in addition to providing support for the rear wheels. This arrangement can also assist with elimination of the rear wheel axle.

Each backrest member can be pivotally connected to its respective mounting hub via a bracket, with each bracket being fastened to a respective side of the backrest member and extending therefrom to a remote end which is adapted for mounting to the hub via a pivot pin arrangement. The brackets can provide for independent delimiting of backrest member pivoting, and can also enable the backrest members to be easily detached from the frame.

For example, each bracket can comprise a slot formation therein whereby, when the bracket is mounted to the hub, the slot formation can be aligned to receive therein a securing pin that projects laterally out from a proximal end of the frame whereby the extent of backrest member pivoting can be limited.

In one embodiment, each securing pin can be spring-loaded to an extended position in which it extends through the slot formation to restrict the bracket and thus the upright member against pivoting. However, each securing pin can be moved against the spring and into a retracted position wherein it is released from the slot formation to free the backrest member for pivoting. This can allow for the collapse of each backrest member to a location against a seat of the wheelchair, such as for storage or transportation, and to enable backrest tilt-back etc.

In use, the first and second backrest members can extend generally upwards with respect to a first cross-bracing member that is located at the frame proximal end, with the securing pins extending from respective opposite ends of the first cross-bracing member. A generally planar seat member can in use be connected to extend forwardly from the first cross-bracing member. This can further assist with elimination of the rear wheel axle. Also, as described below, the use of a generally planar seat member enables the different usage modes (normal, commode, shower etc) to be easily interchanged.

In one embodiment one or more optionally detachable lumbar support braces can extend transversely between the backrest members. The position of detachable lumbar support brace(s) can be adjusted along the backrest members to take into account different user requirements.

In a sixth aspect there is disclosed a wheelchair comprising a generally planar seat member, a backrest extending in use upwardly of the wheelchair adjacent to an in-use rear end of the seat member, and a chair formation that is detachably positionable on the wheelchair to sit on the seat member;

wherein, in use, a backrest portion of the chair formation can be slidably attached down onto and be detachable up from the backrest such that, when slid down onto the backrest, an underside of the chair formation can sit on the seat member.

This arrangement can provide a very comfortable seat for a user and yet which can be easily demounted. The arrangement also enables the height of the chair to be simply adjusted (ie. by selectively positioning the chair formation on the seat member). The arrangement can also be used to provide height compensation (eg. when the rear wheels are each mounted at a lower hub mounting point).

In use, bracing struts can extend from an underside of the seat member adjacent to a distal end thereof and down to a respective part of a frame of the wheelchair. The mounting of the struts to the seat member underside can be adjustable, to enable the angle of the seat member to be adjusted.

The wheelchair typically also comprises front wheels, each front wheel being connectable adjacent to a distal end of a frame of the wheelchair.

BRIEF DESCRIPTION OF THE DRAWINGS

Notwithstanding any other forms that may be embraced by the wheelchair as disclosed in the Summary, specific embodiments of the wheelchair will now be described, by way of example only, with reference to the accompanying drawing in which.

DETAILED DESCRIPTION OF SPECIFIC EMBODIMENTS

Figure 1:
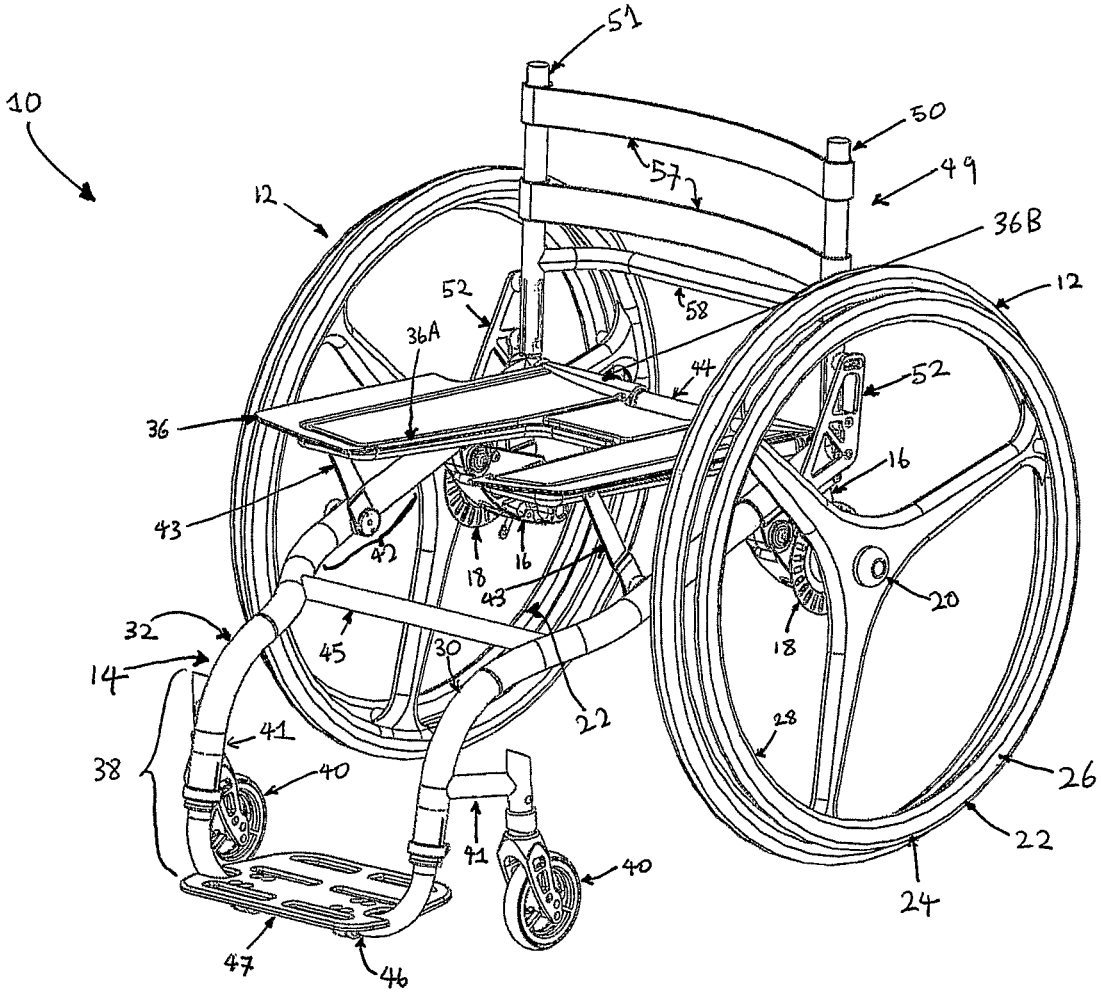
FIG. 1 shows a perspective view of a wheelchair that has normal, commode and shower usage modes.

Referring firstly to FIGS. 1 to 7, a wheelchair 10 is shown that comprises rear wheels 12 that are independently mounted to a frame 14 of the wheelchair. More particularly, each rear wheel 12 is independently mounted to the frame 14 via a respective mounting hub 16, with the hub in turn being independently mounted to the frame.

Figure 3:
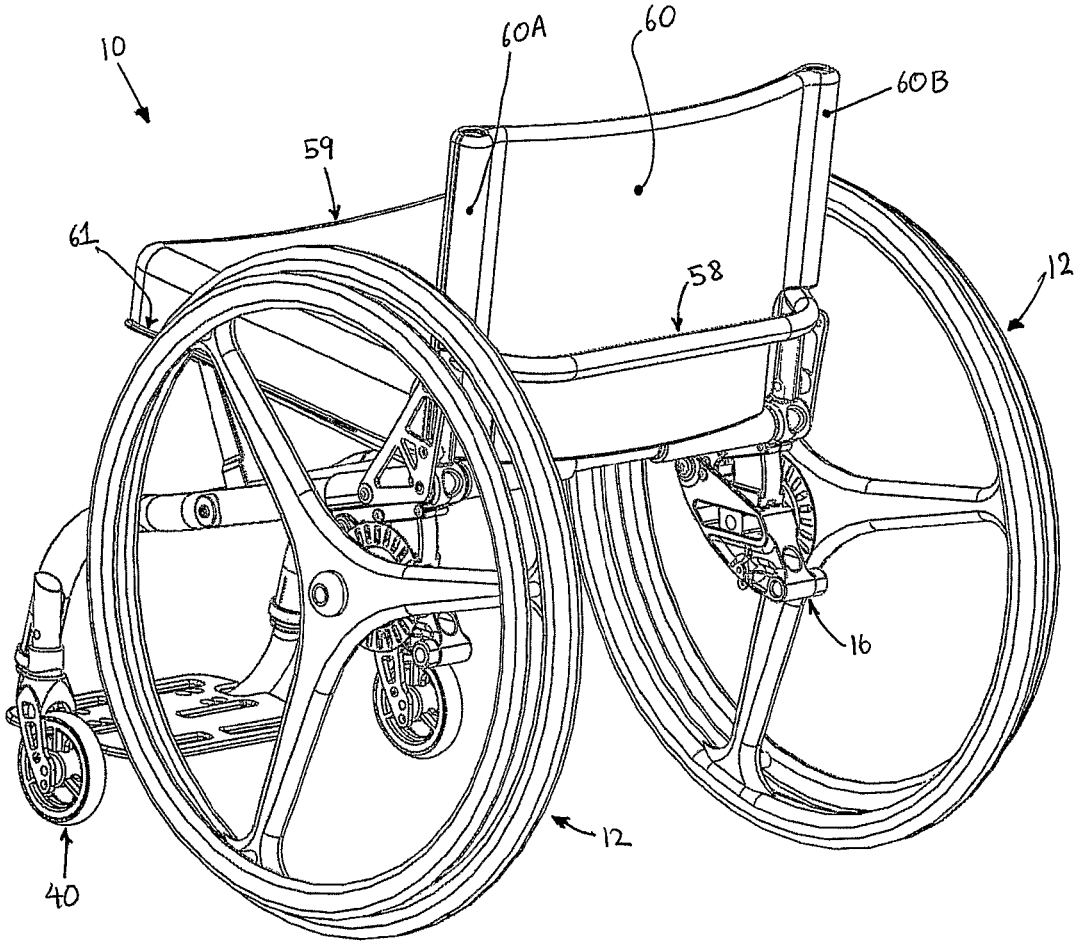
FIG. 3 shows a reverse perspective view to FIG. 2.
Figure 4:
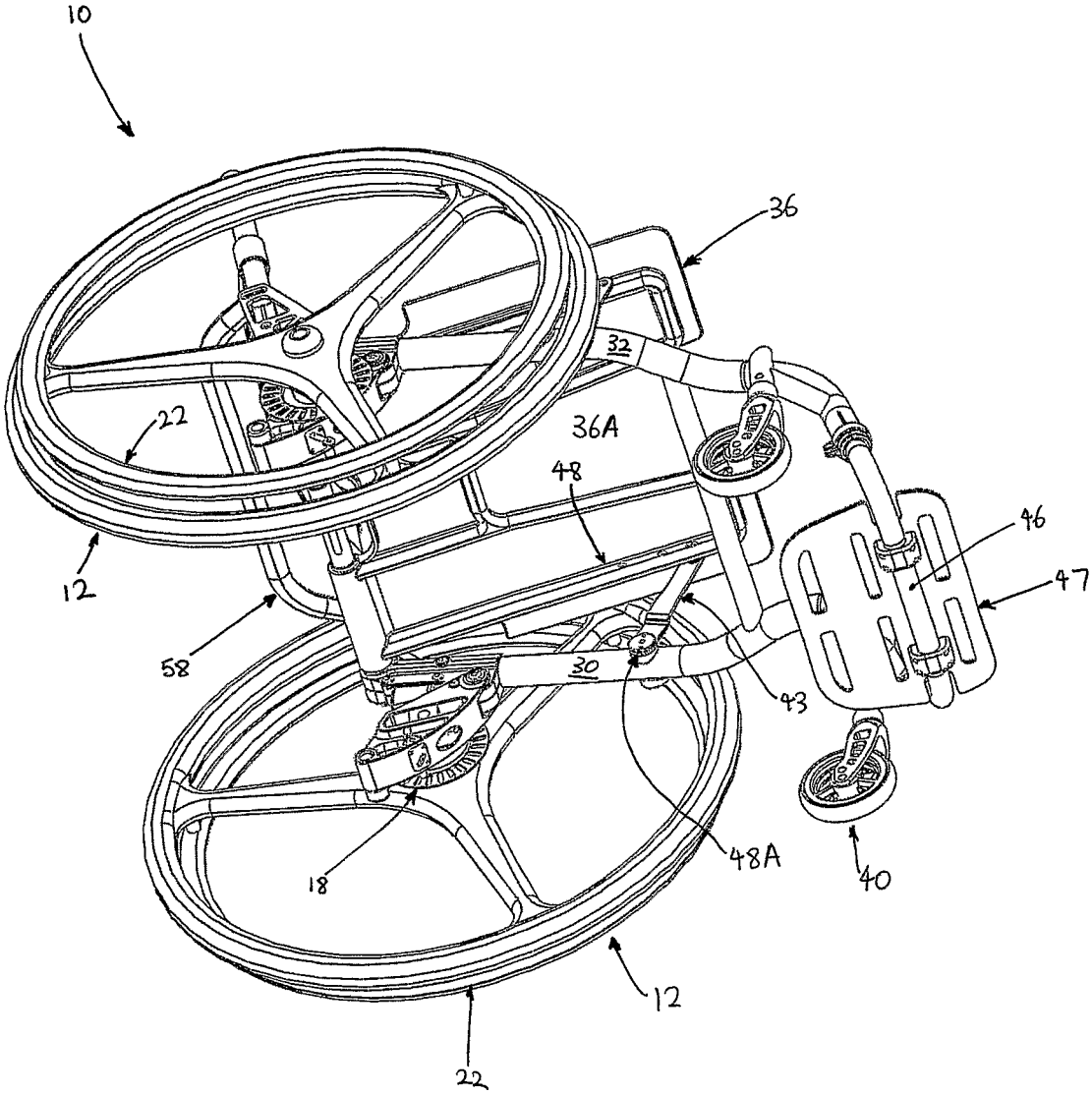
FIG. 4 shows an underside perspective view to FIG. 1.
Figure 13:
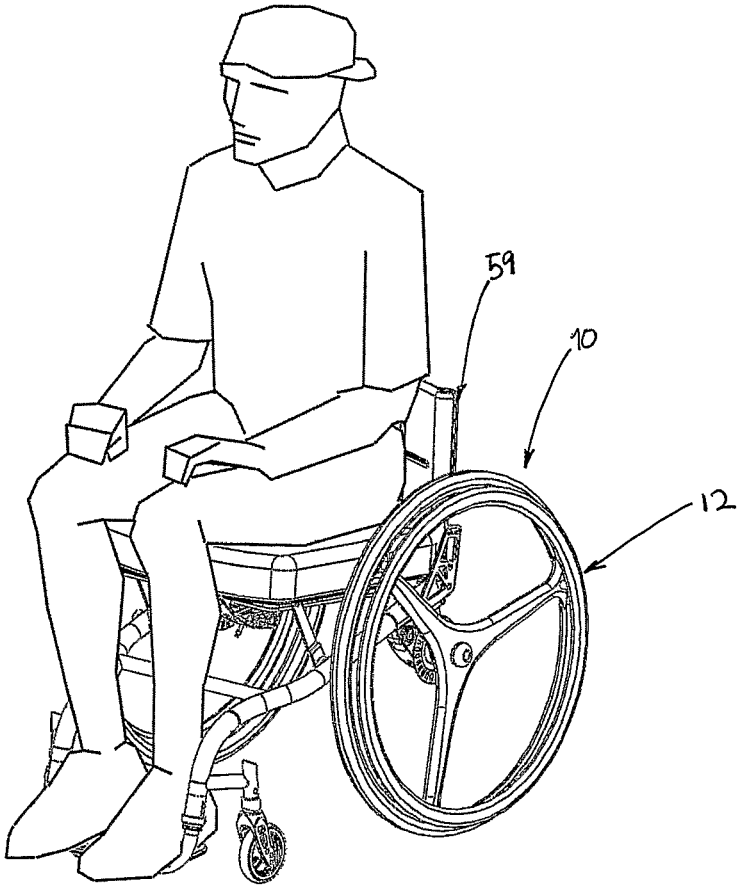
FIG. 13 shows a perspective view of the wheelchair of FIG. 2 with a user in a normal usage mode.
Figure 14:
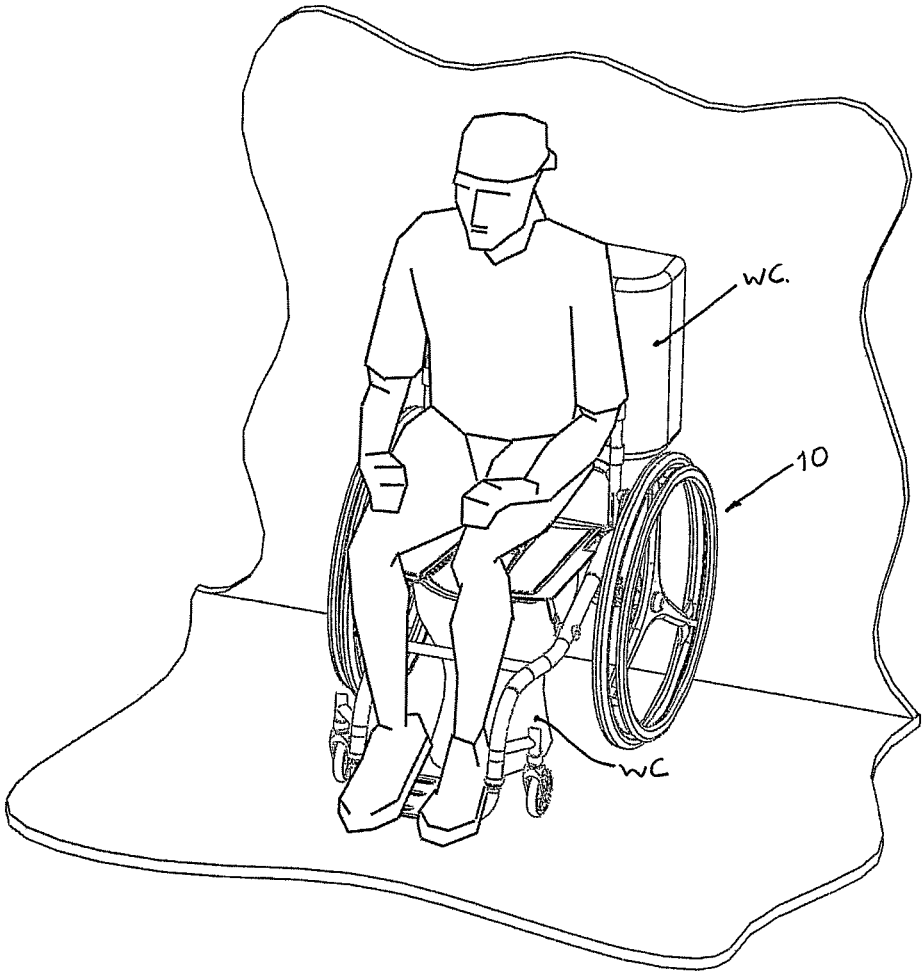
FIGS. 14 and 15 respectively show perspective and side views of the wheelchair of FIG. 1 with a user in a commode/shower usage mode.
Figure 15:
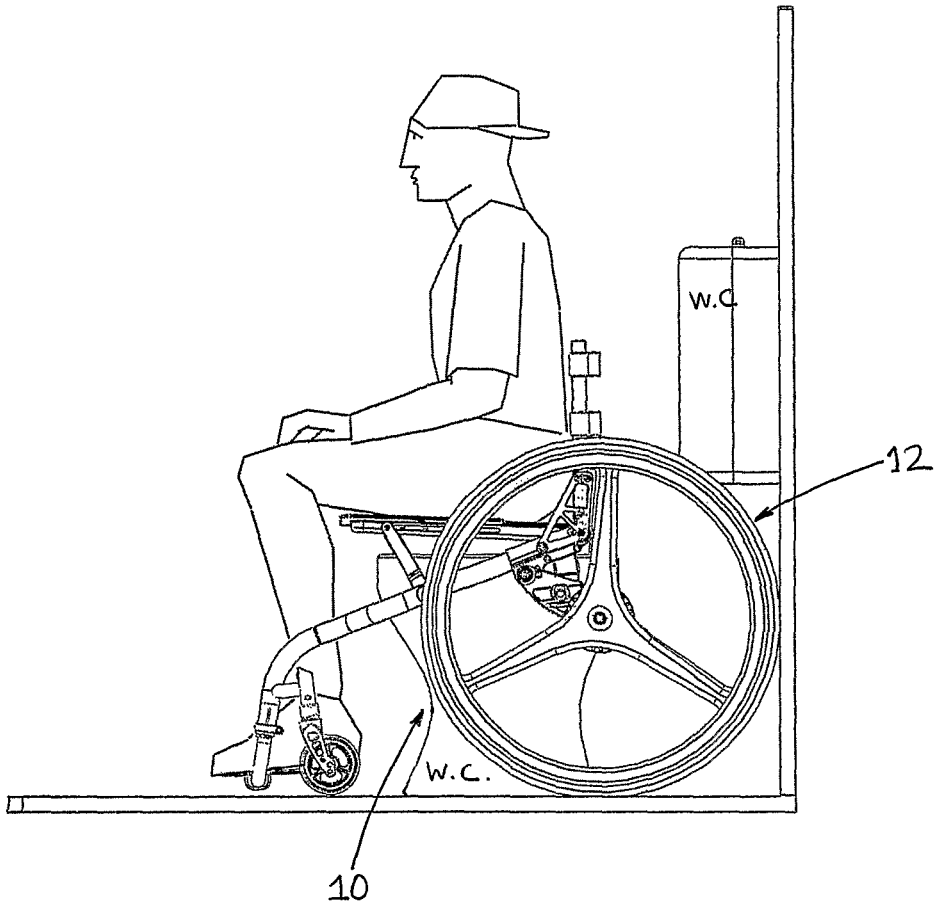

As most clearly seen in FIGS. 3 and 4, the rear wheel mounting has been designed such that a rear axle for the rear wheels has been eliminated. By eliminating the rear axle, the range of applications of the wheelchair can readily be expanded. For example, in addition to a normal chair usage (eg. as shown in FIG. 13), the wheelchair can be adapted to be used as a commode or a shower chair (as shown in FIGS. 14 and 15). Also, by eliminating the rear wheel axle, rear wheel independence can be achieved. Thus, when a configuration such as mounting hub 16 is employed, independent adjustment, suspension and shock absorption of each rear wheel can be attained.

In FIGS. 1 to 7 it will be seen that a disk 18 is positioned for operation between each rear wheel 12 and its respective mounting hub 16. In this regard, the disk is mounted to an inside face of a respective rear wheel hub 20 and, as described below, is located such that a braking pin at the mounting hub 16 can be selectively operated to interfere with the disk to prevent rotation of the rear wheel.

In FIGS. 1 to 7 it will be seen that each rear wheel 12 also comprises a push-rim 22 located externally of the wheel for manual engagement and drive of the wheel. Each push-rim comprises an elastomeric outer layer 24 and an externally facing generally flat side face 26, with both features facilitating manual gripping by a wheelchair user. The outer layer 24 is moulded over a rigid frame 28 of the push-rim.

In FIGS. 1 to 7 it will be seen that the wheelchair main frame 14 comprises first and second spaced apart and unitary (unbroken) tubes 30 and 32. The tubes 30, 32 are each of a unitary and unbroken construction to thereby simplify the overall structure and assembly of the wheelchair. In this sense, the wheelchair can be seen as being constructed around the tube members.

The tubes 30, 32 are typically formed of a special stainless steel alloy that provides a tube having a thin (and a strong but lightweight) wall, with good corrosion resistance. An optimal material is known Nanoflex material (trade mark of Sandvik AB). Even with thin walls, Nanoflex has very high mechanical properties (ultra high strength combined with good toughness) and high corrosion resistance. For example, the weight of the chair, in its folded position, can be reduced to 5.1 kg.

Figure 8:
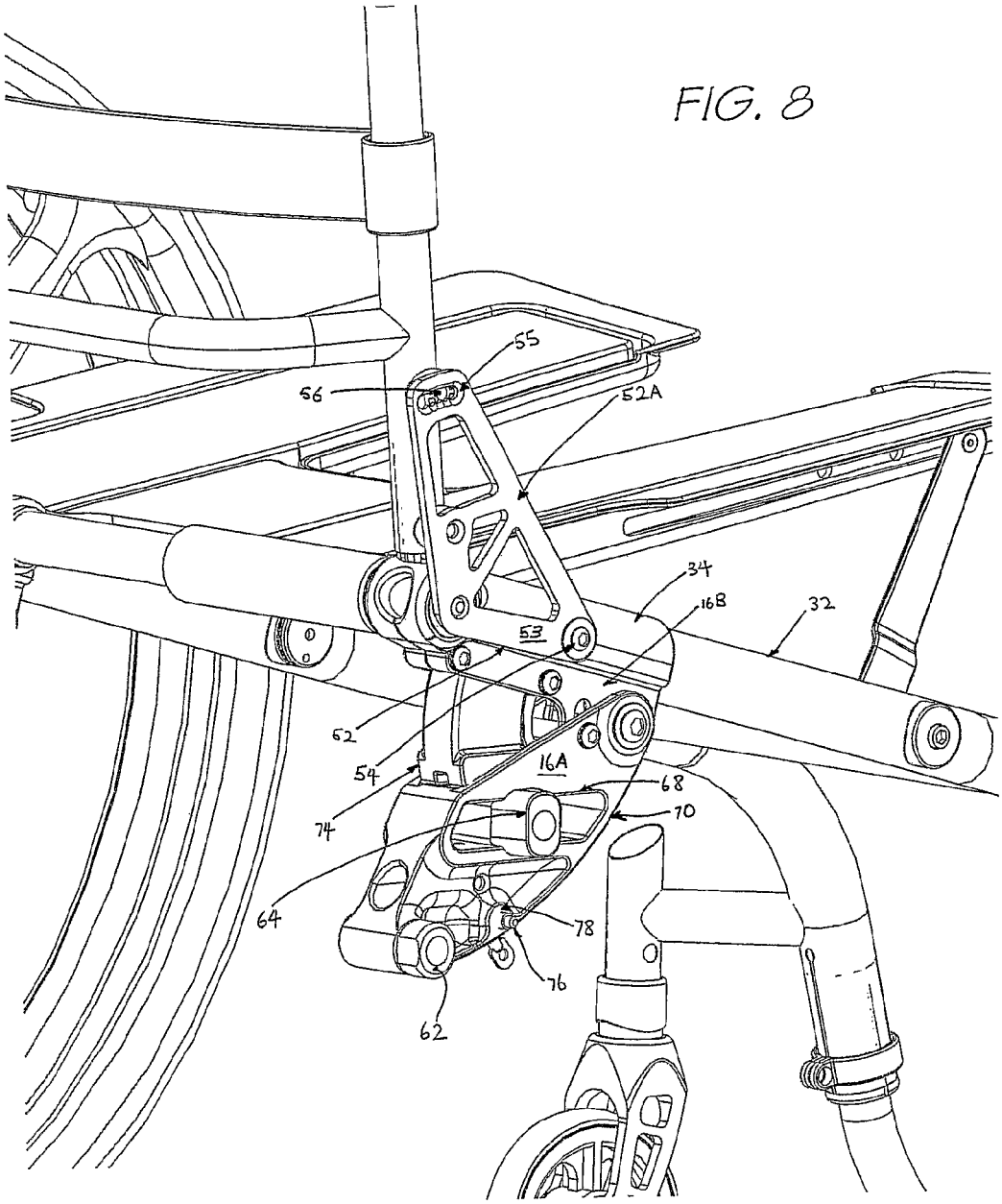
FIGS. 8 to 10 show different details of the wheelchair of FIG. 2.
Figure 9:
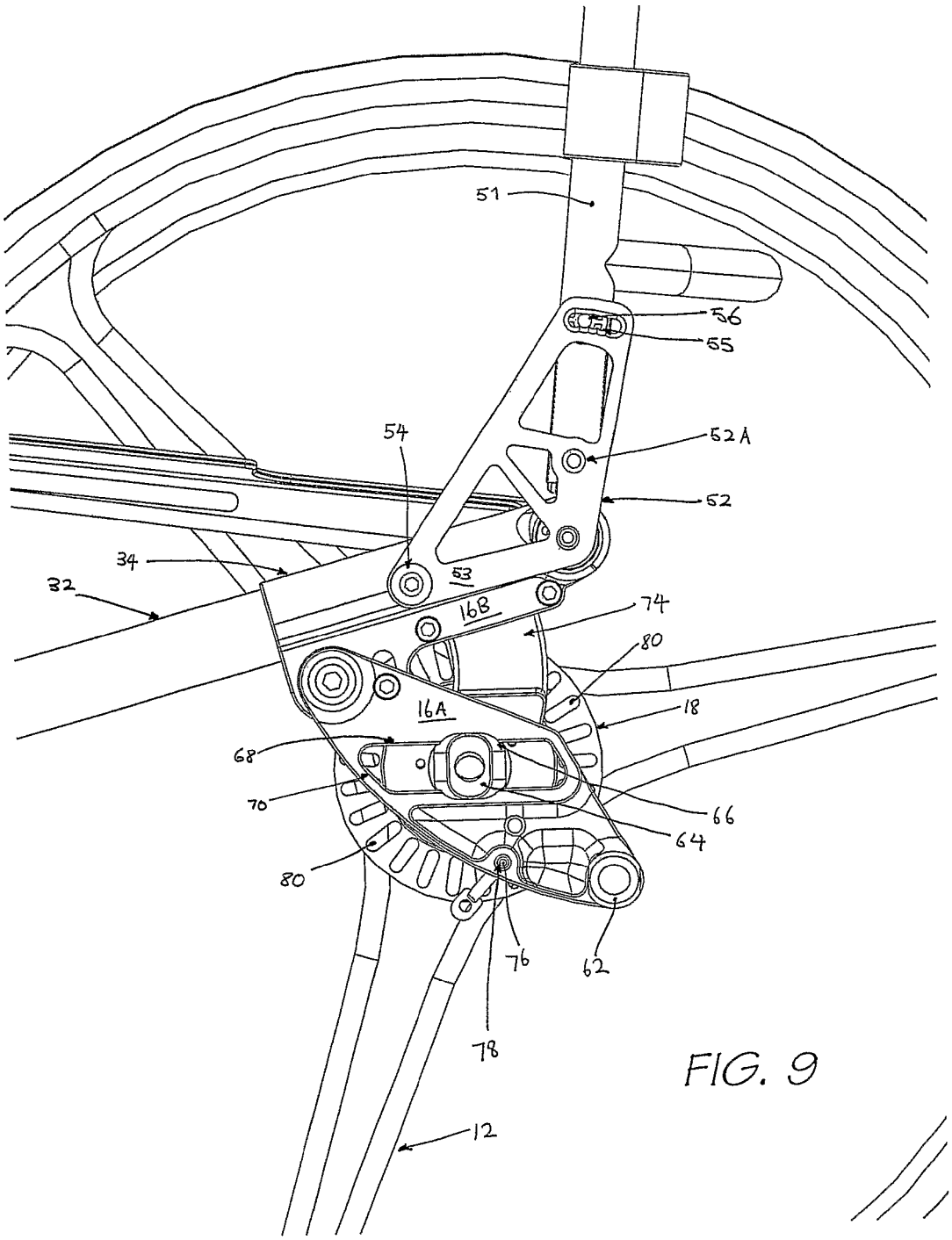

As best shown in FIGS. 8 and 9, each mounting hub 16 is mounted to its respective tube via hub mounting brackets 34. Each bracket is keyed on its respective tube 30, 32, is slidable therealong, and can be locked against sliding by two screws. This can allow for overall mounting hub positional adjustment (eg. post production).

A generally planar wheelchair seat 36 is supported between the main frame tubes 30, 32. The seat 36 comprises a cut-away portion 36A to facilitate its commodal/shower usage. A detachable insert can be located in that portion during normal usage mode.

Further, the main frame tubes 30, 32 each comprise a first generally downwardly sloping portion 38 to which a respective front wheel 40 is mounted via a coupling configuration 41. The first portion 38 curves up to a second generally more gradually sloped portion 42, with respective sides of the seat 36 being mounted to portion 42 via adjustable seat bracing arms 43.

The tubes 30, 32 are interconnected by at least two spaced cross-bracing tubes (eg. located at proximal (seat) and distal (foot) ends of the frame). In the wheelchair 10 depicted three interchangeable and spaced cross-bracing tubes 44, 45 and 46 are employed. The first cross-bracing tube 44 is located at a proximal (or seat) end of the first and second tubes 30, 32. The second cross-bracing tube 45 is located intermediate the proximal end and a distal end of the first and second tubes 30, 32 (eg. adjacent to the curved section between portions 38 and 42). The third cross-bracing tube 46 is located at the distal end. A footrest plate 47 is mounted at the third cross-bracing tube 46 via clips at the plate underside which enable the footrest plate to be tilted about the tube 46.

The interchangeability of the cross-bracing tubes 44, 45 and 46 enables the spacing between the first and second tubes 30, 32 to be altered (eg. to accommodate different sized users such as users of different widths), in this regard, different length tubes can simply be interchanged.

Figure 5:
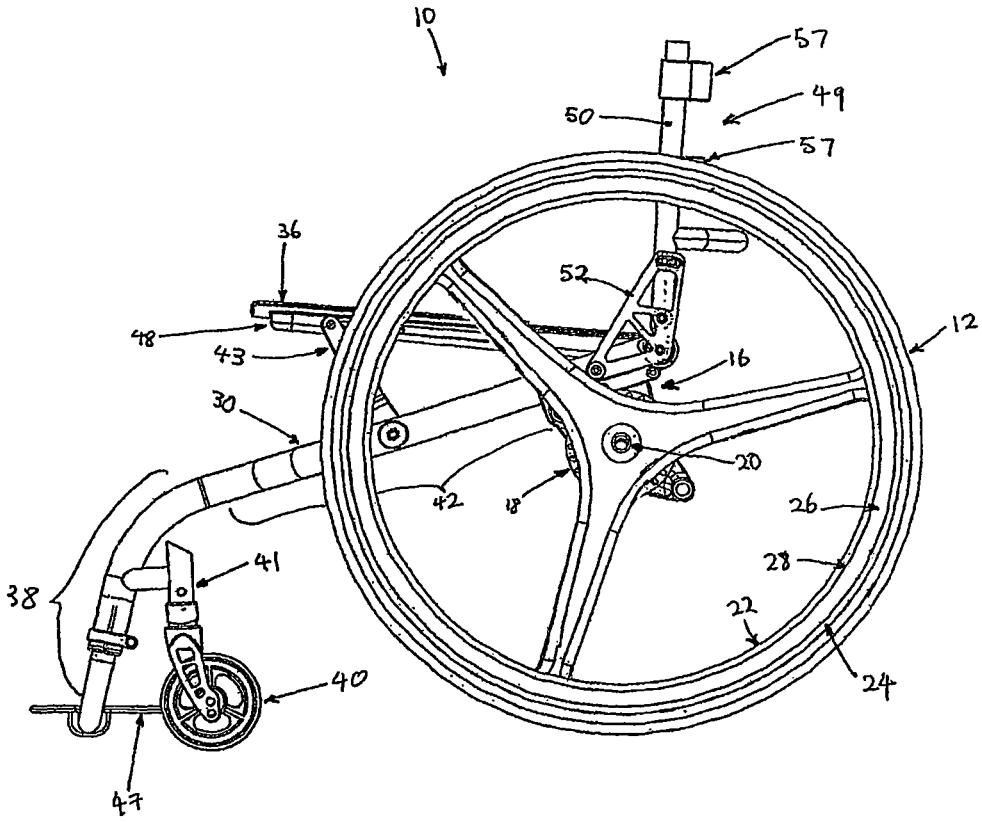
FIGS. 5 to 7 respectively show side, plan and front views of the wheelchair of FIG. 1.
Figure 6:
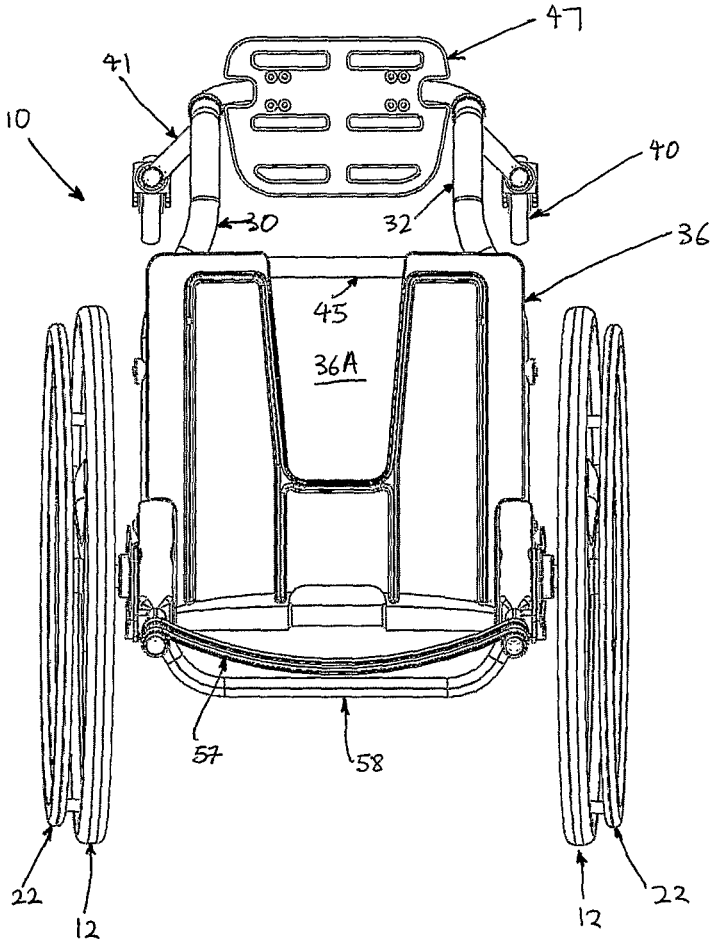
Figure 7:
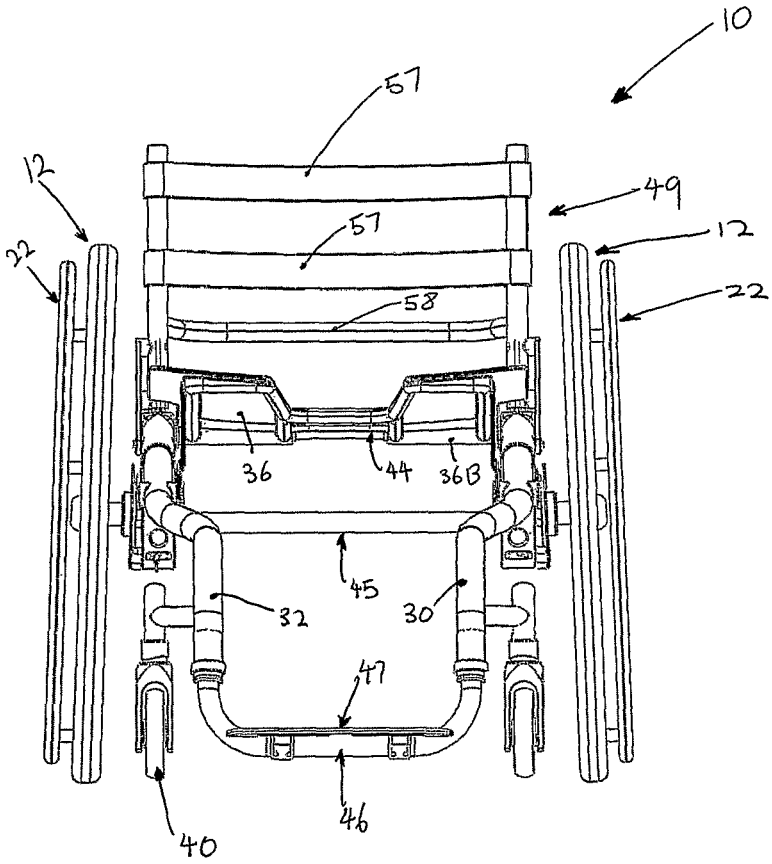

The seat 36 is pivotally connected via seat sleeves 36B to extend forwardly from the first cross-bracing tube 44. Also, as best shown in FIGS. 4 and 5, an upper end of each bracing arm 43 extends from a respective track 48 located at an underside of the seat 36 and can be locked in that track (eg. via a locking pin configuration). A lower bracing arm end is connected to tube 30 or 32 via a mounting 48A. When the seat 36 extends generally horizontally in use, the end of arm 43 at track 48 is located adjacent to a distal end of the seat, with the arm inclining down to a respective main frame tube 30 or 32. However, the seat inclination can be adjusted to accommodate different user requirements by moving (eg. sliding) the end of arm 43 with respect to track 48, from its location adjacent the distal seat end to different points in the track 48 and then locking the arm end thereat. For example, angles of seat inclination can be selected by the user such as 6°, 10°, 12.5° and 15°, with the arm 43 being returned to a 0° angle when in the commode/shower usage mode.

As best shown in FIG. 8, each mounting hub 16 is positioned at the proximal end adjacent to the first cross-bracing tube 44 so that each mounting hub is located near to where the tubes 30, 32 are braced. This provides for a more stable transfer of reactive forces to the frame via each hub, and is an optimal construction for elimination of the rear wheel axle.

In FIGS. 1 to 7 it will also be seen that a wheelchair backrest 49 is mounted with respect to the main frame tubes 30, 32. The backrest 49 comprises first and second backrest tubes 50 and 51 which in use can extend generally upwards from the proximal (seat) end of the main frame tubes (in effect extending generally upwards from the first cross-bracing tube 44).

Each backrest tube is pivotally connected with respect to the frame 14 via a respective mounting bracket 52 that is pivotally coupled to a respective mounting hub 16 to enable adjustment of the backrest 49 with respect to the frame. Thus, in addition to providing support for the rear wheels, the mounting hubs 16 also support the backrest tubes independently of the frame. The brackets 52 enable independent mounting for and delimiting of backrest tube pivoting. This can again help to eliminate a wheelchair rear wheel axle.

As best shown in FIGS. 8 and 9, each bracket 52 is fastened (eg. riveted) to a respective side of a backrest tube at two points 52A and extends therefrom to a remote end 53 which is adapted for mounting to the hub via a pivot pin arrangement 54. Each bracket also comprises a slot 55, with the slot aligning with a respective spring-loaded securing pin 56 projecting out from each adjacent end of the first cross-bracing tube 44.

Figure 11:
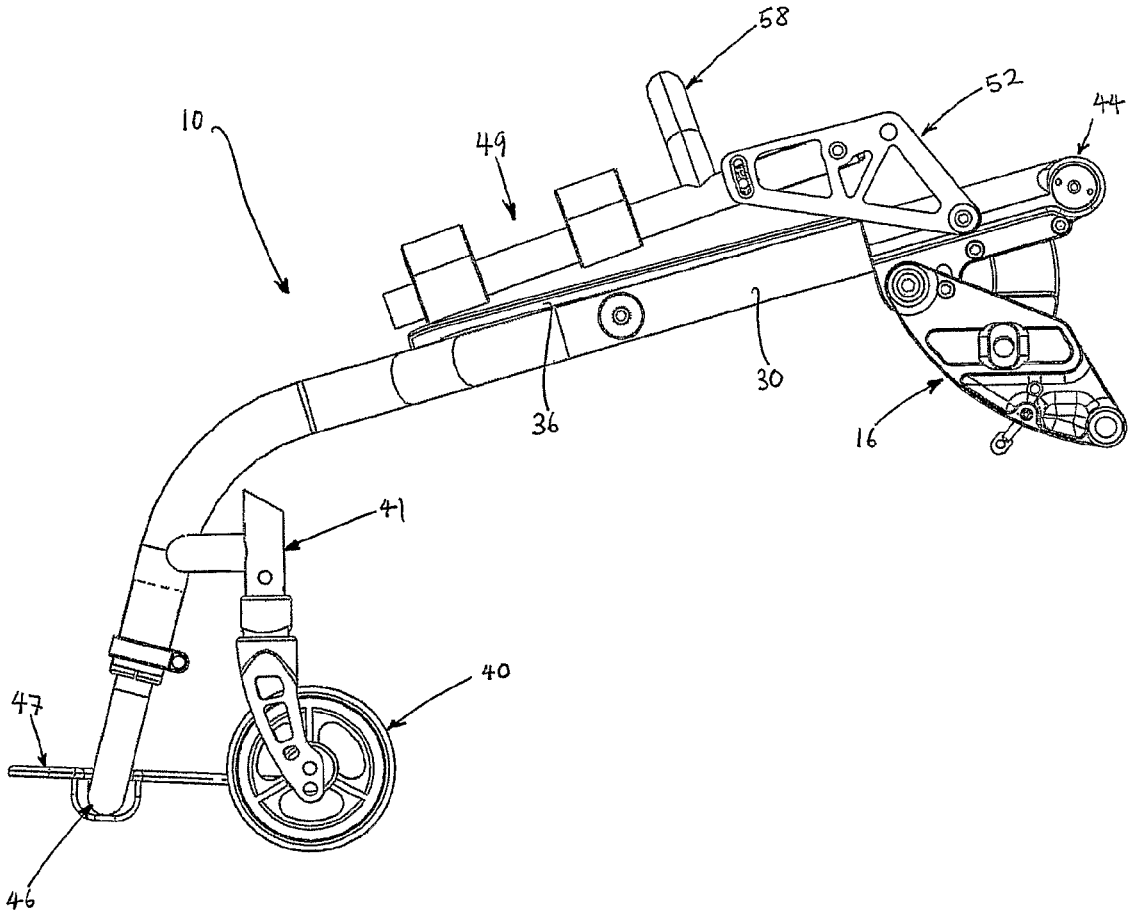
FIGS. 11 and 12 respectively show side and perspective views of the wheelchair of FIG. 1 in a collapsed mode.
Figure 12:
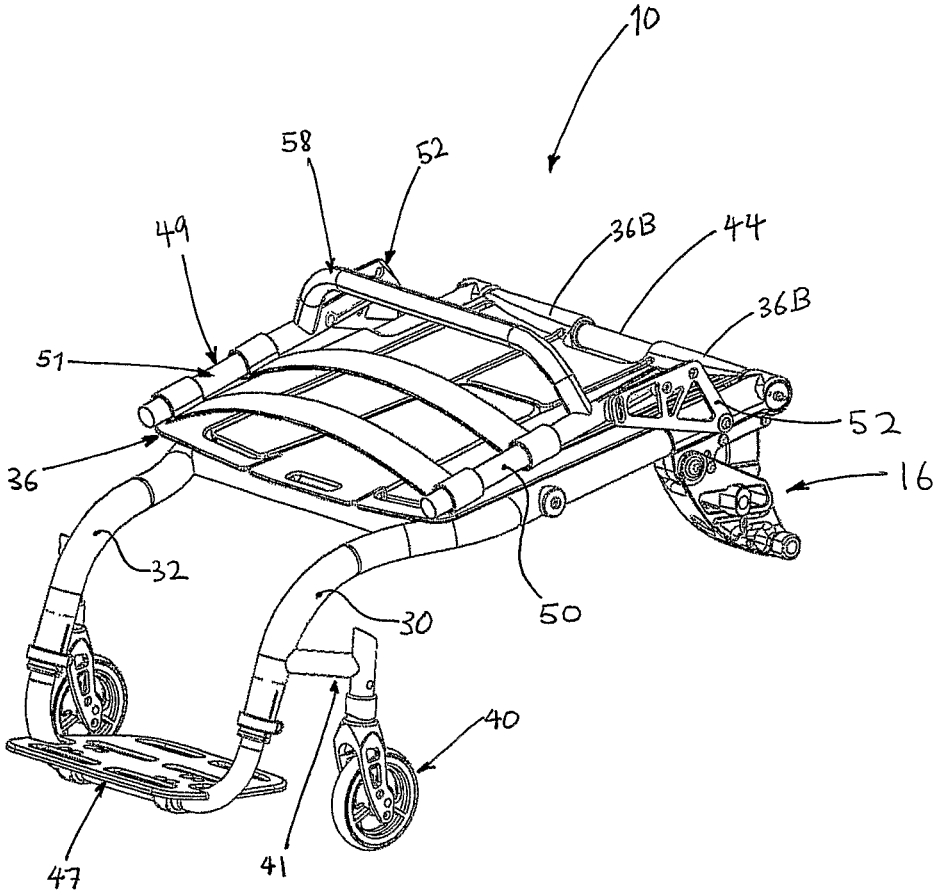

Each securing pin 56 limits the extent of pivoting of each backrest tube 50, 51. In this regard, each pin is spring-loaded at an extended position from the first cross-bracing tube 44 in which it restricts the bracket 52 and thus the respective tube 50 or 51 against pivoting. However, each securing pin can be moved against the spring and into a retracted position wherein it is released from the slot 55, to free the bracket 52 and thus tube 50 or 51 for pivoting. This enables, for example, the collapse of the backrest 49 to a location against the seat 36 of the wheelchair (such as shown in FIGS. 11 and 12) for storage, transportation etc. The slot also enables the backrest to be progressively tilted back etc.

Three detachable lumbar support straps 57 and a backrest-stabilising cross brace 58 extend transversely between the backrest tubes 50, 51. The detachability of the lumbar support straps 57 allows them to be adjusted in position along the backrest tubes 50, 51 to take into account different user requirements. For example, the straps 57 can be secured at each end to a respective tube 50 or 51 via a wrap-around Velcro® hook & loop fastening system.

Figure 2:
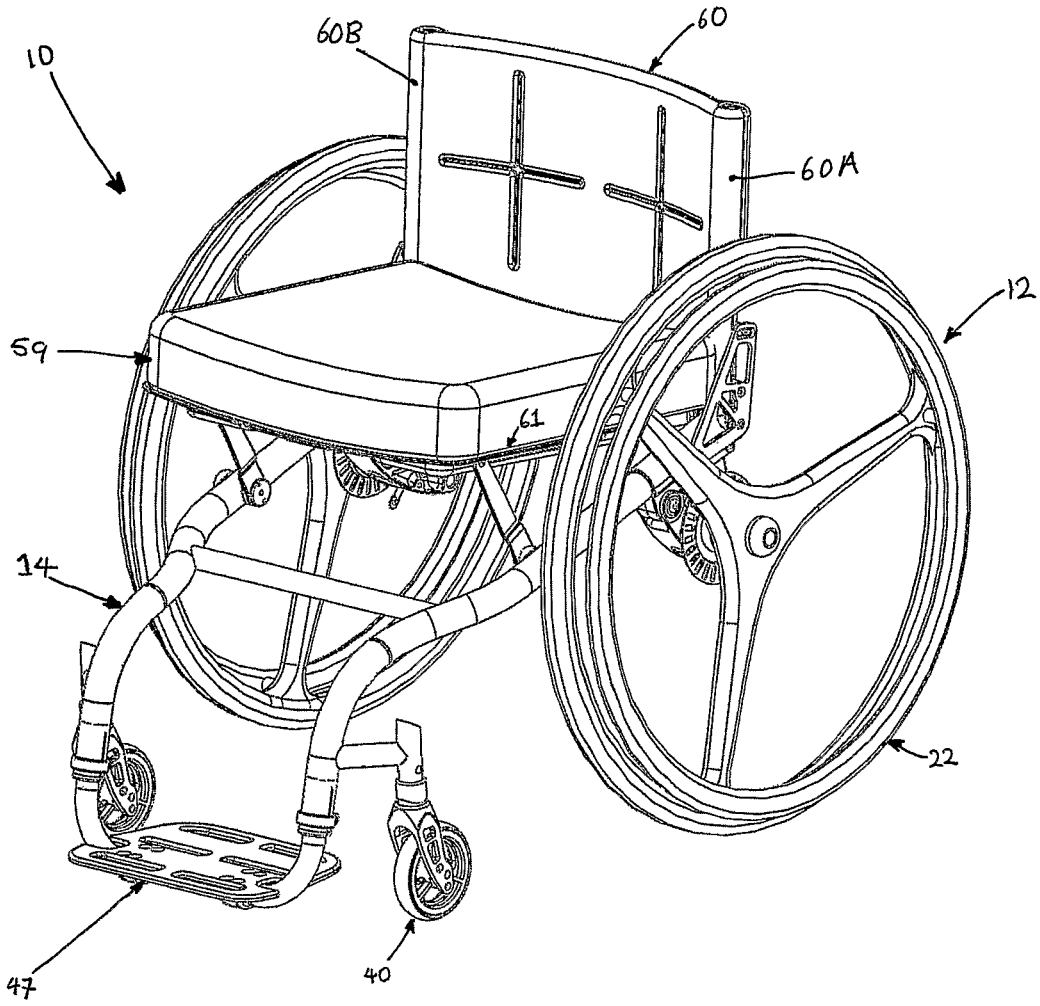
FIG. 2 shows a perspective view of the wheelchair of FIG. 1 in a normal usage mode (with chair formation added)

Referring now specifically to FIGS. 2 and 3, a padded chair component 59 can be detachably mounted to the wheelchair to sit on the seat 36 as shown. In this regard, a backrest portion 60 of the chair component can be slidably attached down onto and detached up from the wheelchair backrest 49 such that, when slid down onto the backrest, an underside 61 of the chair component sits on the seat 36. More particularly, tubular formations 6OA and 6OB of the backrest portion 60 engage and slidingly receive the respective backrest tubes 50, 51 therein.

Referring again to FIGS. 8 and 9 it will be seen that each mounting hub 16 comprises two distinct mounting points at respective mounting bushes 62 and 64, with the bushes enabling interchange of the rear wheel mounting location. Of course, more than two distinct mounting points can be positioned in hub 16, although for clarity just two such points are shown and will now be described.

By providing distinct hub mounting points the configuration of the wheelchair can simply and readily be altered. For example, mounting bush 62 is positioned in the mounting hub 16 at a location that in use is lower than that of mounting bush 64. This enables the in-use height of the wheelchair frame to be altered to adapt the wheelchair to its different modes of use.

Alternatively, mounting bush 62 can be laterally positioned with respect to mounting bush 64, so that the rear wheels 12 can be shifted forwardly or rearwardly with respect to the frame. Combinations of height and lateral offset are also possible.

In any case, the lower mounting bush 62 is used when the wheelchair is in its "commode" or "shower" mode of usage and the chair component 59 has been detached from the wheelchair.

This gives the chair sufficient height such that the seat 36 can clear a WC (FIGS. 14 and 15). The higher mounting bush 64 is used when the wheelchair is in its "normal" mode of usage and the chair component 59 is attached to the wheelchair (FIG. 13). This lowers the chair's height to a level such that, with the chair component 59 attached and sitting on seat 36, a standard seating level for a user is reached. Thus, in the commode/shower mode an underside of seat 36 is 430 mm above the ground and in the normal mode an underside of seat 36 is 380 mm above the ground. The differential mounting point configuration in hub 16 thereby enables the height of the wheelchair to be simply adjusted.

Additionally, the position in the mounting hub 16 of the mounting bush 64 is adjustable forwards and backwards, thus moving the rear wheel mounting point forwards and backwards with respect to the frame 14. In this regard, the upper external surface of the mounting bush 64 is teethed or knurled at 66. These teeth can then interact with inwardly facing teeth 68 of an elongate sleeve formation 70 defined in hub 16. The adjustment forwards and backwards is achieved by removing and reinserting bush 64 at a new position in sleeve 70, and this enables the rear wheel centreline to be correspondingly altered with respect to the frame. This can change the performance of the wheelchair (eg. the rear wheel centreline can be selectively moved by a user to an optimal position). It can also allow for different user weight distributions to be accommodated (eg. the rear wheel centreline can be repositioned depending on where a given user normally sits in the chair).

Whilst two mounting bushes/points are depicted, if desired, additional mounting points can be moulded into the mounting hub 16 to provide for further height and rear wheel centreline variation. Also, the hub 16 can be modified such that the rear wheels need not be detached to effect movement of the wheels (eg. via a pivoting or sliding mount arrangement) between the different mounting points.

The inclination of rear wheel mounting at a given mounting point can also be changed to enable rear wheel camber to be altered. In this regard, each of the bushes 62, 64 is detachable from the hub to enable it to be interchanged with a bush that has an internal bore having a different (eg. more pronounced) inclination to horizontal. This can allow for wheelchair camber adjustment. Camber adjustment can in turn enable a wheelchair to be used on different surfaces (eg. a grassy or resilient surface as opposed to a hard pavement, road etc). Most typically at least bush 64 is interchangeable as camber adjustment is mainly to be employed during the "normal" mode of wheelchair use.

Figure 10:
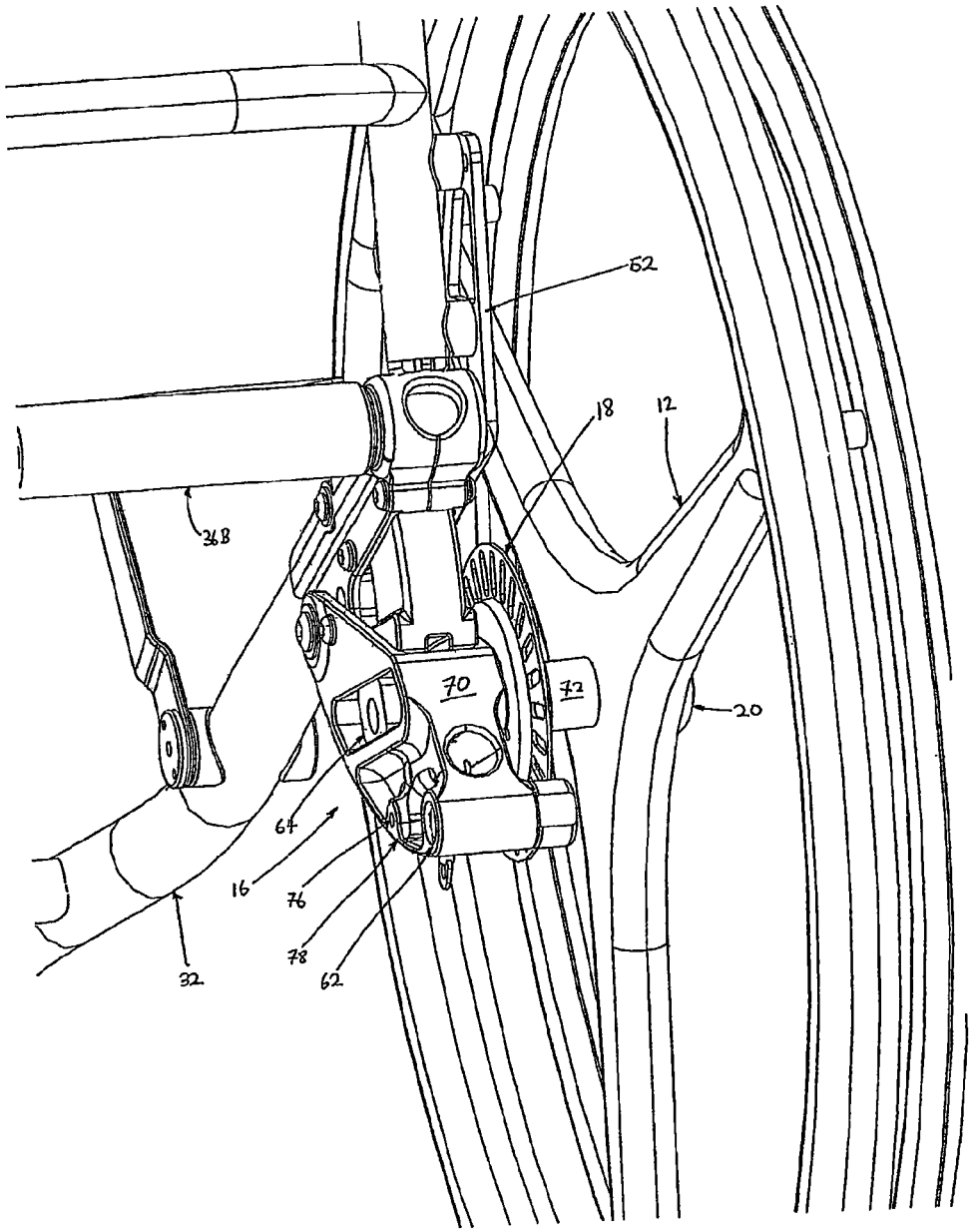

As best shown in FIG. 10 each rear wheel has a mounting pin that protrudes from a rear portion 72 of the wheel hub 20, and through disk 18, to be releasably received in an internal bore of each of the bushes 62, 64. The mounting pin can be provided as a quick-release pin to enable rapid attachment/detachment of each rear wheel from the mounting hub 16. The quick-release pin can take the form of a positive locking pin, a ring detent pin, a shoulder detent pin, a knob detent pin, a lynch pin, a wirelock pin, a magnetic selector pin or a threaded detent pin etc.

Again, as best shown in FIGS. 8 and 9 the mounting hub 16 is shown as comprising a pivoting hub portion 16A and a fixed hub portion 16B, the latter being fixed to a respective one of the frame tubes 32 (or 30) via the hub mounting bracket 34. Either (but typically both) of the mounting bushes 62 and 64 are located in the pivoting hub portion 16 A. Whilst a pivoting arrangement is depicted, the hub portion 16A can move in other ways with respect to the fixed hub portion 16B (eg. a slide mount arrangement towards and away from the fixed hub portion 16B). This capability of the mounting point to move (eg. to pivot) can enable a suspension characteristic to be provided to each rear wheel.

In this regard, a shock absorber element in the form of a specially moulded silicon/rubber block 74 can be positioned to act between the hub portions 16A and 16B, to provide each rear wheel with its own shock absorption capability. For simplicity, the shock absorber comprises a polymeric rubber block, although mechanical or hydraulic suspension can be employed as required. The block 74 can also be interchanged for service, to vary the shock absorption characteristics of each wheel, and to make minor height adjustments for the wheelchair at each frame side (ie. by using a differently sized block).

A height adjustment mechanism that acts between hub portions 16A and 16B can also be provided, either in place of or additionally to the silicon/rubber block 74. The height adjustment mechanism can comprise a screw mechanism located for operation between the hub portions 16A and 16B, whereby small frame height adjustments up and down can be made. Again, this mechanism can enable the frame at a given side of the wheelchair to be independently height adjusted so that specific user requirements can be accommodated.

As best shown in FIGS. 9 and 10, each disk 18 is located such that a braking pin 76 located at the mounting hub can be selectively operated to interfere with the disk to prevent rear wheel rotation. This enables a given rear wheel to be locked against rotation, for example, in a fail-safe mode of operation, thereby providing additional safety benefits to the wheelchair.

More particularly, the braking pin 76 Is spring-loaded into an extended position to ensure a fail-safe mode of operation. However, the braking pin is displaceable into a sleeve 78 formed in the mounting hub 16 whereby it is retained in a retracted position and no longer interferes with the disk. From there it can be re-released to move back to the extended position (e.g. by pressing on a rear side of the pin or, more easily, by a remote operated trigger on a cable connected to the pins, such as found with pushbike components that are remotely operated by cable).

The braking pin 76 interferes with the disk 18 in the extended position by extending through an aligned one of a plurality of elongate slots 80 defined within the disk and thereby prevents rear wheel rotation. Each of the slots 80 can be curved as shown or be straight. In either case, when moving to the extended position, the braking pin can still extend through one of the slots at different pivotal positions of the mounting hub with respect to the frame and at different positions of bush 64 in sleeve 70. Also, hub portion 16A can still pivot about hub portion 16B with the pin in its extended position, so that shock absorption/suspension can still take place in a rear wheel locked state.

EXAMPLE

When Nanoflex was used as the tube material, a finite element analysis of the wheelchair was conducted and identified a safety factor of 12:1, when the chair was loaded under 85 kg top load with a simultaneous side load of 75 kg. This compared most favourably against a heavier and larger titanium tube.

Once formed into the desired frame shape, a low temperature heat treatment increased the strength of the Nanoflex material up to 2,000 MPa in tensile and 1,800 MPa in yield strength, with a hardness of 58 HRC. This compared favourably against a calculated desirable yield strength of 1700 MPa.

Two tubes were used to manufacture the wheelchair frame. These were:

1. 31.8 O.D.×30.7 LD.; wall thickness 0.55 mm;
2. 22.2 O.D.×21.1 LD.; wall thickness 0.55 mm.

Such tubes were able to provide the above mechanical properties with the very thin walls specified. In fact, where rigidity was a desirable property, the high modulus of elasticity of the Nanoflex material resulted in thinner, lighter components than components produced in aluminium.

It was observed that known wheelchairs used titanium to achieve less strength, also at the expense of increased weight of the wheelchairs.

The applicant was also able to bend the Nanoflex material into the relative tight radiuses required in the wheelchair (heretofore not previously achieved). The Nanoflex material thus provided a low weight, high strength stainless steel having good corrosion resistance, dimensional stability and, after the final heat treatment, good resistance to high temperatures. The Nanoflex material also had a readily obtainable hard surface so there was no need for hard chroming of parts, with the surface appearance being more than satisfactory from an aesthetic perspective.

It will therefore be seen that the wheelchair 10 can provide for each of the following:

- no rear wheel axle;
- at least two different operating heights;
- rear wheel suspension;
- seat height adjustment;
- an independently hinging backrest;
- rear wheel independent support and detachability;
- rear wheel horizontal adjustment;
- rear wheel camber alteration;
- fail safe braking;
- framework and hub mounting that tends towards anti-tipping;
- height alteration to allow the wheelchair to be used over a W.C. and in a shower;
- adjustment of the seat and backrest angles;
- a folding action that can tuck the seat and the backrest inside the frame;
- greatly reduced overall dimensions of the wheelchair (eg. when folded, small enough be stowed in overhead compartments of an aeroplane);

with the upholstery removed the wheelchair can function as a commode and as a shower chair.

Whilst a number of wheelchair embodiments have been described, it should be appreciated that the wheelchair can be embodied in many other forms.

In the claims which follow and in the preceding description, except where the context requires otherwise due to express language or necessary implication, the word "comprise" or variations such as "comprises" or "comprising" is used in an inclusive sense, i.e. to specify the presence of the stated features but not to preclude the presence or addition of further features.

The invention claimed is:

1. A wheelchair comprising:

a frame;

first and second rear wheels that are each independently mounted to the frame;

a first mounting hub comprising a fixed portion, fixedly mounted to the frame, and a pivotable portion, that is pivotably attached to said first mounting hub fixed portion; and a second mounting hub comprising a fixed portion, fixedly mounted to the frame, and a pivotable portion, that is pivotably attached to said second mounting hub fixed portion, the first rear wheel being independently mounted to the frame via said first mounting hub at a hub mounting point located in said first mounting hub pivotable portion, and the second rear wheel being independently mounted to the frame via said second mounting hub at a hub mounting point located in said second mounting hub pivotable portion, wherein a first shock absorber is positioned and mounted between the first mounting hub fixed and pivotable portions and a second shock absorber is positioned and mounted between the second mounting hub fixed and pivotable portions, and wherein the respective mounting hub pivotable portions are pivotally mounted to an in-use proximal region of the respective mounting hub fixed portions, with the shock absorbers being located for operation at a location that is remote from the respective proximal regions.

2. A wheelchair as claimed in claim 1 wherein the frame comprises first and second spaced apart unitary tubes which each extend in an unbroken manner from a wheelchair seat to a forward region of the wheelchair.

3. A wheelchair as claimed in claim 2 wherein first and second backrest members are respectively mounted to proximal ends of each of the first and second tubes, and a respective rear wheel mounting hub is fastened to each of the first and second tubes adjacent to their proximal ends.

4. A wheelchair as claimed in claim 3 wherein each backrest member is pivotally connected to the frame via a respective mounting hub via a bracket to enable adjustment of the backrest members with respect to the frame, with each bracket being fastened to a respective side of the backrest member and extending therefrom to a remote end which is adapted for mounting to the mounting hub via a pivot pin arrangement.

5. A wheelchair as claimed in claim 4 wherein each bracket comprises a slot formation therein whereby, when the bracket is mounted to the mounting hub, the slot formation can be aligned to receive therein a securing pin that projects laterally out from a proximal end of the frame whereby the extent of backrest member pivoting can be limited, with each securing pin being spring-loaded to an extended position in which it extends through the slot formation to restrict the bracket and thus the backrest member against pivoting, but wherein each securing pin can be moved against the spring and into a retracted position wherein it is released from the slot formation to free the backrest member for pivoting.

6. A wheelchair as claimed in claim 5 wherein, in use, the first and second backrest members extend generally upwards with respect to a first cross-bracing member that is located at the frame proximal end, with the securing pins extending from respective opposite ends of the first cross-bracing member, and wherein the wheelchair seat is in use connected to extend forwardly from the first cross-bracing member.

7. A wheelchair as claimed in claim 6 wherein the wheelchair seat comprises a detachable insert, the removal of which enables the wheelchair seat to function in shower and commode modes.

8. A wheelchair as claimed in claim 2 wherein, in use, each of the first and second tubes has, at the forward region, a first generally downwardly sloped portion to which a respective front wheel can be mounted, with the first portion curving back to a second generally more gradually sloped portion to which a respective side of the seat together with a respective rear wheel can be mounted.

9. A wheelchair as claimed in claim 8 wherein the first and second tubes are interconnected by at least two spaced cross-bracing members, with a first cross-bracing member being located to extend between proximal ends of each tube, and with a second cross-bracing member extending between the tubes at a location that is spaced from the first cross-bracing member.

10. A wheelchair as claimed in claim 9 comprising three spaced cross-bracing members that are defined by:

the first cross-bracing member located at the proximal ends of each tube;

the second cross-bracing member which is located intermediate the proximal ends of each tube and distal ends of each tubes; and a third cross-bracing member located at the distal ends of each tube; and wherein a footrest can be mounted at the third cross-bracing member.

11. A wheelchair as claimed in claim 1 wherein each hub mounting point, at which each rear wheel is detachably mounted to its respective mounting hub pivotable portion, is selected from two or more distinct hub mounting points for each respective rear wheel whereby, in use of the wheelchair, at least one of the hub mounting points is positioned in the mounting hub pivotable portion at a location lower than another of the hub mounting points to enable a mounting location of each rear wheel to be changed, wherein the in use height of the wheelchair frame can be altered.

12. A wheelchair as claimed in claim 11 wherein, in use of the wheelchair, at least one of the hub mounting points is adjustable in the mounting hub pivotable portion forwards and backwards with respect to the frame to enable a rear wheel centreline to be correspondingly altered with respect to the frame.

13. A wheelchair as claimed in claim 12 wherein the hub mounting point that is adjustable is a bush adapted to be moved along an elongate sleeve formation, with the bush being removable from the sleeve and repositionable therein at a new location along the sleeve.

14. A wheelchair as claimed in claim 1 further comprising a disk positionable for operation between at least one of the rear wheels and the mounting hub at which the rear wheel can be mounted to the frame of the wheelchair, the disk being located such that a stop element located at the mounting hub can be selectively operated to interfere with the disk to prevent rotation of the rear wheel.

15. A wheelchair as claimed in claim 14 wherein the disk is fixedly mounted with respect to the rear wheel, and wherein the stop element is a braking pin located at the wheel mounting hub and is selectively extendable from the wheel mounting hub whereby, in an extended position, the braking pin interferes with the disk to prevent rear wheel rotation.

16. A wheelchair as claimed in claim 15 wherein the disk further comprises a plurality of slots, wherein the braking pin is spring-loaded into the extended position whereby it extends through one of the slots to positively prevent the rear wheel rotation, but can be displaced into and retained at a retracted position whereby it is withdrawn from the slot.

17. A wheelchair as claimed in claim 1 wherein an inclination of rear wheel mounting at a respective mounting point can be changed such that rear wheel camber can be altered, with the inclination of the respective hub mounting point being changed by interchanging a bush of the respective hub mounting point with a bush that has an internal bore having a different inclination.

* * * * *

UNITED STATES PATENT AND TRADEMARK OFFICE

CERTIFICATE OF CORRECTION

PATENT NO. : 8,573,622 B2
APPLICATION NO. : 12/295913
DATED : November 5, 2013
INVENTOR(S) : Papi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 935 days.

Signed and Sealed this
Twenty-second Day of September, 2015

Michelle K. Lee

Michelle K. Lee
*Director of the United States Patent and Trademark Office*